US007143907B2

(12) United States Patent
Gehn et al.

(10) Patent No.: US 7,143,907 B2
(45) Date of Patent: Dec. 5, 2006

(54) DISPENSER ASSEMBLY INCLUDING A ROTATING DISPENSING CAROUSEL

(75) Inventors: William D. Gehn, Red Wing, MN (US); Richard J. Curtin, Red Wing, MN (US); Peter von Haaren, Red Wing, MN (US); Bruce H. Koerner, Red Wing, MN (US)

(73) Assignee: Automated Equipment, LLC., Red Wing, MN (US)

( * ) Notice: Subject to any disclaimer, the term of this patent is extended or adjusted under 35 U.S.C. 154(b) by 117 days.

(21) Appl. No.: 10/099,869

(22) Filed: Mar. 15, 2002

(65) Prior Publication Data

US 2002/0162860 A1 Nov. 7, 2002

Related U.S. Application Data

(60) Provisional application No. 60/276,981, filed on Mar. 19, 2001.

(51) Int. Cl.
*G01F 11/00* (2006.01)

(52) U.S. Cl. ..... 222/1; 222/63; 222/183; 222/333; 222/414; 222/504

(58) Field of Classification Search ..... 222/1, 222/63, 146.6, 181.1, 183, 185.1, 333, 414, 222/504

See application file for complete search history.

(56) References Cited

U.S. PATENT DOCUMENTS

| | | | | |
|---|---|---|---|---|
| 2,057,768 | A * | 10/1936 | De Motte | 48/53 |
| 2,201,808 | A * | 5/1940 | Berwick et al. | 222/133 |
| 2,684,782 | A | 7/1954 | Lime et al. | 221/174 |
| 3,831,818 | A * | 8/1974 | Dumont | 222/129 |
| 4,308,929 | A | 1/1982 | Estavoyer | 177/210 |
| 4,513,892 | A | 4/1985 | Koeneman et al. | 222/235 |
| 4,662,538 | A | 5/1987 | Goudy, Jr. et al. | 221/265 |
| 4,856,681 | A | 8/1989 | Murray | 222/158 |
| 5,285,925 | A | 2/1994 | Leight | 221/1 |
| 5,788,119 | A | 8/1998 | Esclar et al. | 222/58 |
| D402,853 | S | 12/1998 | Fritze et al. | D7/589 |
| 5,891,246 | A | 4/1999 | Lund | 118/13 |
| 5,960,990 | A * | 10/1999 | Radosevich | 222/1 |
| 6,125,894 | A | 10/2000 | Fritze et al. | 141/83 |
| 6,131,622 | A | 10/2000 | Fritze et al. | 141/196 |
| 6,305,573 | B1 | 10/2001 | Fritze et al. | 222/58 |
| 6,367,777 | B1 | 4/2002 | Fritze et al. | 254/98 |

FOREIGN PATENT DOCUMENTS

| | | |
|---|---|---|
| FR | 2.184.446 | 12/1973 |

* cited by examiner

*Primary Examiner*—Joseph A. Kaufman
(74) *Attorney, Agent, or Firm*—Westman, Champlin & Kelly P.A.

(57) ABSTRACT

A dispenser apparatus including a rotating carousel to feed material from an inlet to a discharge outlet. In the illustrated embodiments, the carousel includes a cone shaped portion to facilitate material flow to dispense a metered quantity of material. The apparatus described has particular application for dispensing a glutinous particulate or material. In an illustrated embodiment, a scale is used to control metered quantities which as described includes cantilevered beams supporting a floating tray for measuring a dispensed quantity.

22 Claims, 14 Drawing Sheets

DISPENSER ASSEMBLY INCLUDING A ROTATING DISPENSING CAROUSEL

The present application claims priority to U.S. provisional patent application Ser. No. 60/276,981, filed Mar. 19, 2001 and entitled "FOOD PRODUCT DISPENSER".

BACKGROUND OF THE INVENTION

The present invention relates to a dispensing apparatus and in particular, to a dispensing apparatus having particular utility for a glutinous material or particulate.

Industrial or commercial applications employ apparatus to dispense a product or material. For example, some apparatus dispense a metered quantity of material or substance for use or consumption. The process of dispensing a metered quantity has application for food products and other material. In different dispensing applications, it is difficult to control the dispensing process, this is particularly so for glutinous substances or particulate. The present invention addresses these and other problems and provides solutions not recognized nor appreciated by the prior art.

SUMMARY OF THE INVENTION

The present invention relates to a dispenser apparatus including a rotating carousel to feed material from an inlet to a discharge outlet. In the illustrated embodiments, the carousel includes a cone shaped portion to facilitate material flow to dispense a metered quantity of material. The apparatus described has particular application for dispensing a glutinous particulate or material. In an illustrated embodiment, a scale is used to control metered quantities which as described includes cantilevered beams supporting a floating tray for measuring a dispensed quantity.

DETAILED DESCRIPTION OF THE PREFERRED EMBODIMENTS

Figure 1:
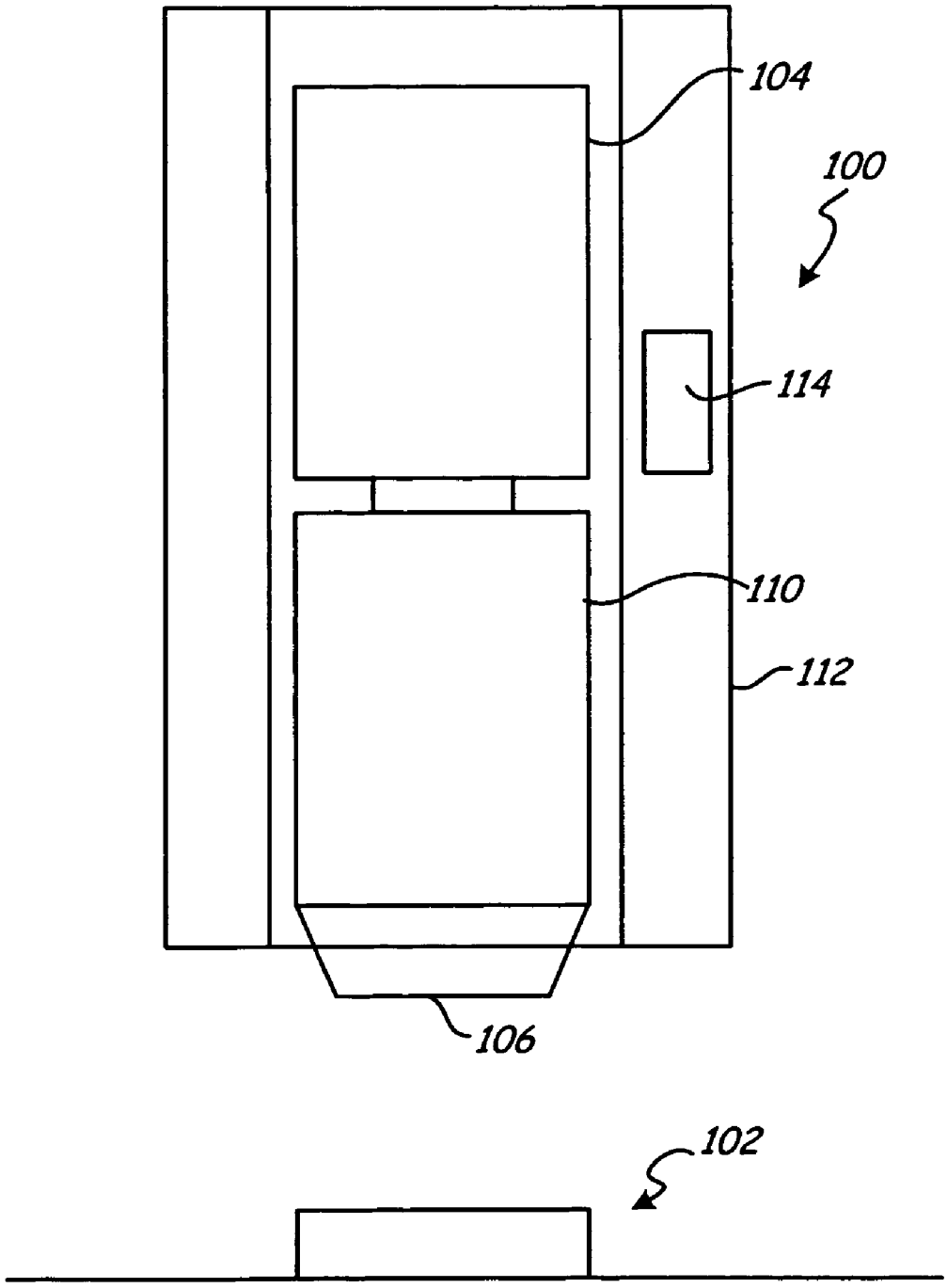
FIG. 1 is a schematic illustration of a dispenser assembly or apparatus.

FIG. 1 schematically illustrates an embodiment of a dispenser apparatus 100 for dispensing product or material 102 from source 104 through a dispenser outlet 106. Product or material is fed from an inlet (illustrated schematically) using a rotating assembly or carousel 110. In the schematically illustrated embodiment, the dispensing components are housed in a cabinet 112 and material is dispensed through the outlet 106. Dispensing operation can be controlled through a control panel 114 including input or control buttons or similar devices (not shown).

Figure 2:
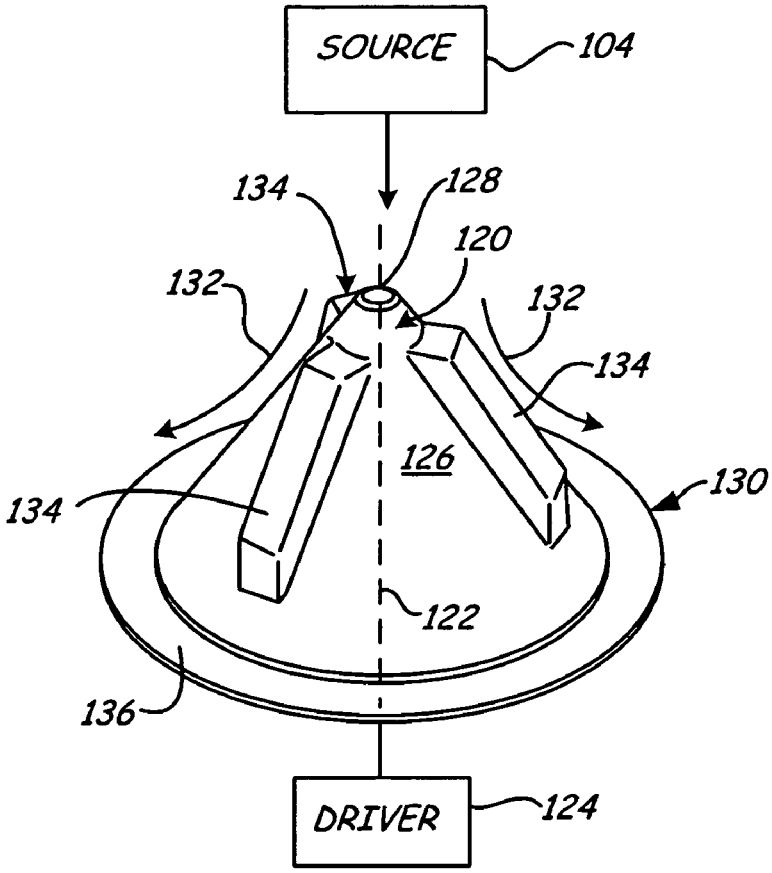
FIG. 2 is a schematic illustration of an embodiment of a dispenser carousel.

FIG. 2 illustrates an embodiment of a dispenser carousel 120 of assembly 110 to move or feed product from the source 104 for dispensing. The carousel 120 is interposed in a flow path between inlet and outlet 106 and as shown, is rotated about an axis 122 by a drive or motor 124 to dispense material. As shown, the carousel 120 includes a cone shaped portion 126 having a length extending along axis 122 and coned shaped diameter extending radially outwardly from a tip 128 of the cone shaped portion 126 toward a base 130 of the cone shaped portion 126. Material from source 104 drops towards the rotating carousel 120 and is moved along a radially directed flow path as illustrated by arrow 132 via the cone shape of the carousel and operation of the drive or motor 124 rotating the carousel 120.

The carousel 120 described has particular application for feeding glutinous material or particulate such as shredded cheese which has a relatively high moisture content. The high moisture content of shredded cheese can cause cheese particles to stick together creating a big blob of cheese which is difficult to dispense and is undesirable as well. The flared cone-shaped portion enhances radial dispersion of particulate or material in cooperation with rotation of the carousel 120 to separate particulate or material for dispersment.

Preferably, the carousel is formed of a plastic or other material having a sufficiently lubricous surface so that particulate or material slides outwardly towards the base of the carousel 120. In the embodiment illustrated, the carousel 120 includes a plurality of longitudinally aligned ribs 134 on the cone shaped portion along the flow path which assists with movement or flow of the material or particulate via rotation of the carousel 120. In one embodiment, the cone shaped portion 126 includes three (3) ribs 134 spaced 120° apart.

Figure 3:
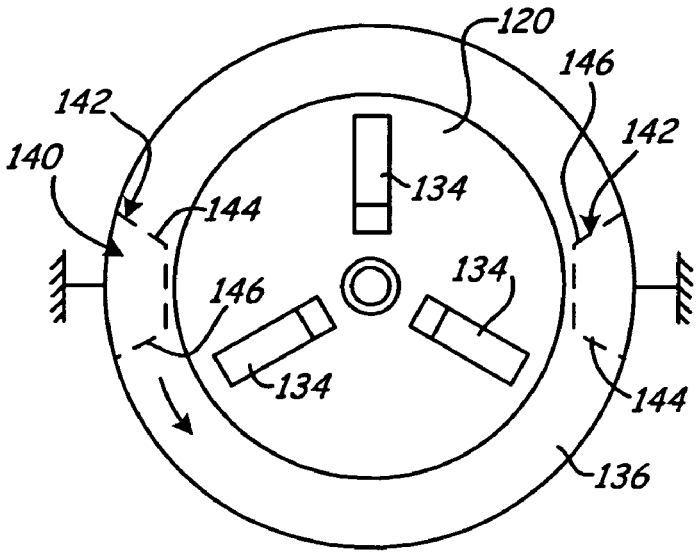
FIG. 3 is a schematic illustration of an embodiment of a blade assembly for dispensing material from a dispenser carousel.

As illustrated in FIG. 2, the carousel 120 includes a base flange 136 extending from the cone shaped portion 126. Material is radially dispersed from source 104 to base flange 136 for discharge by a blade assembly 140 illustrated in FIG. 3. In the embodiment illustrated in FIG. 3, the blade assembly 140 includes a plurality of radially spaced blades 142 (illustrated in phantom in FIG. 3) which circumferentially push or propel material from the flange 136 as the carousel 120 rotates for operation.

Figure 4:
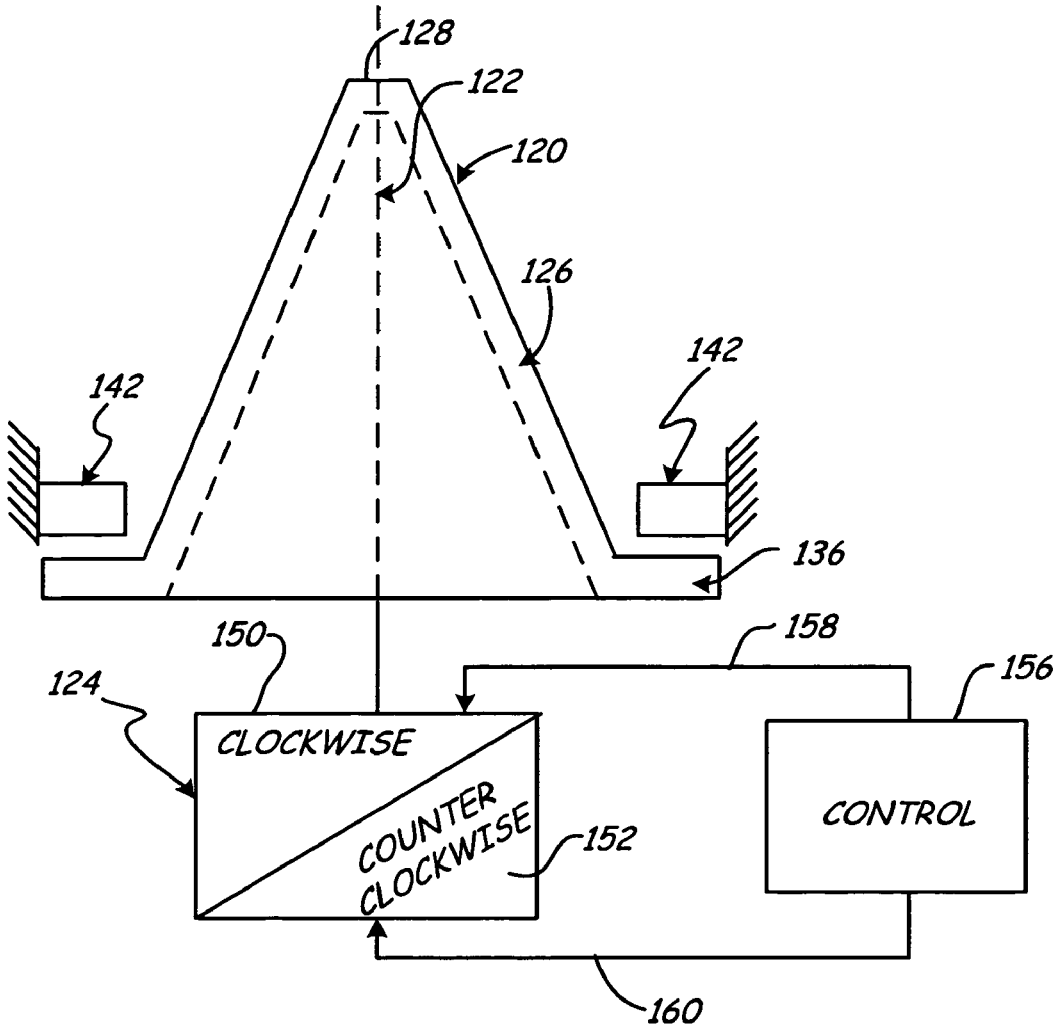
FIG. 4 is a schematic elevational illustration of an embodiment of a dispenser carousel and blade assembly.

In the illustrated embodiment of FIG. 4, the base flange 136 is generally traverse to the rotation axis 122 to provide a flat surface to contain product or material following rotation of the carousel 120 for a dispensing cycle or operating period for metered dispensing control. FIG. 4 illustrates an embodiment of a dispenser carousel having bidirectional operation. The bidirectional operation helps keep the carousel 120 free from build-up which has particular application for sticky or glutinous particulate or materials.

As shown, driver 124 includes a clockwise mode 150 and a counterclockwise mode 152 selectively operable via control 156 in response to a dispense command. In particular, control 156 operates the motor in a first dispensing cycle in the clockwise mode 150 as illustrated by line 158 to rotate carousel 120 in a clockwise direction. In the embodiment illustrated in FIG. 3, blades 142 include opposed angled interface surfaces 144, 146. In the clockwise direction, interface surface 144 of blade 142 pushes material from the base flange 136.

Control 156 operates the motor or driver 124 in a sequential dispensing cycle in the counterclockwise mode 152 as illustrated by line 160 to rotate the carousel 120 in a counterclockwise direction. In the counterclockwise direction interface surface 146 pushes material to radially discharge material from the base flange 136. The bidirectional rotation reduces build-up of material on the dispensing components and has particular application for gummy particulate or material. In the embodiment illustrated in FIG. 4, blades 142 are offset from the base flange 136 to reduce stiction or "build-up". For example in application for shredded cheese, blades 142 are offset approximately ⅛" inch from the flange 136.

Figure 5:
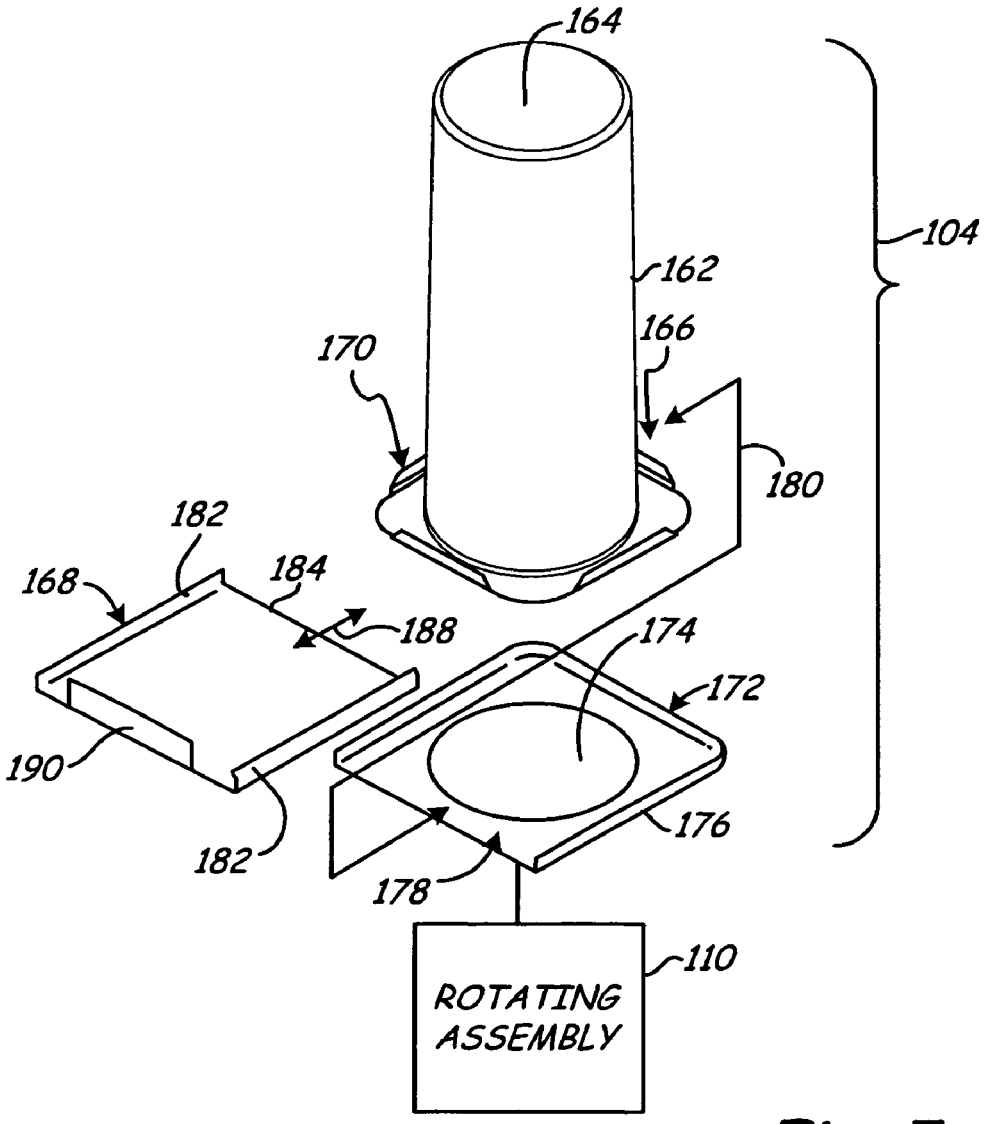
FIG. 5 illustrates an embodiment of a removable container assembly for a dispenser assembly or apparatus.

FIG. 5 schematically illustrates an embodiment of a removable container 162 to supply material to the inlet for dispensing. The removable container 162 is selectively installed for dispensing operations and can be removed and replaced, or removed and reinstalled following an idle period. In the illustrated embodiment, the container 162 is cylindrically shaped and includes a closed end 164 and an opened flanged end 166 (not visible) which is closed by a slidable cover 168.

As shown, the opened flanged end 166 of the container 162 includes raised edges 170 and slidably mates with a flanged platform 172 of the dispensing assembly. As shown, platform 172 includes an opening 174 therein which forms the inlet to the dispensing or rotating assembly portion. The platform 172 includes an outer raised edge 176 thereabout and a slot opening 178 through which the opened flanged end 166 of the container 162 is installed as illustrated by arrow 180. Cover 168 is formed of a "plate-like" closure having raised edge portions 182 and a slot opening 184. Cover 168 slides over the opened end of the container via insertion of the opened flanged end 166 through the slot 184 as illustrated by arrow 188 so that raised edges 170 of the container and edge portions 182 of the cover mate for alignment.

The opened flanged end 166 of the container 162 is installed on the flanged platform 172 with the cover 168 slidable disposed thereon. For use the cover 168 is slidably removed by gripping or grasping raised lip 190 as illustrated by bidirectional arrow 188 to slidably remove the cover 168 from between the opened fanged end 166 and the assembly platform 172 to open the container. The cover 168 is reinserted to close the container 162 prior to removing the container from the platform 172 for storage and/or replacement.

Thus, as described, containers can be prepackaged or filled and the prepackaged containers can be selectively installed for use and can be easily removed and replaced when emptied. Further partially emptied containers can be covered and removed during interruptions in dispensing operation, for example to clean and/or store perishable material or food. In the illustrated embodiment, container 162 is tapered outwardly towards platform 172 to facilitate product or material flow. In one embodiment, the container 162 has a 1° taper.

Figure 6:
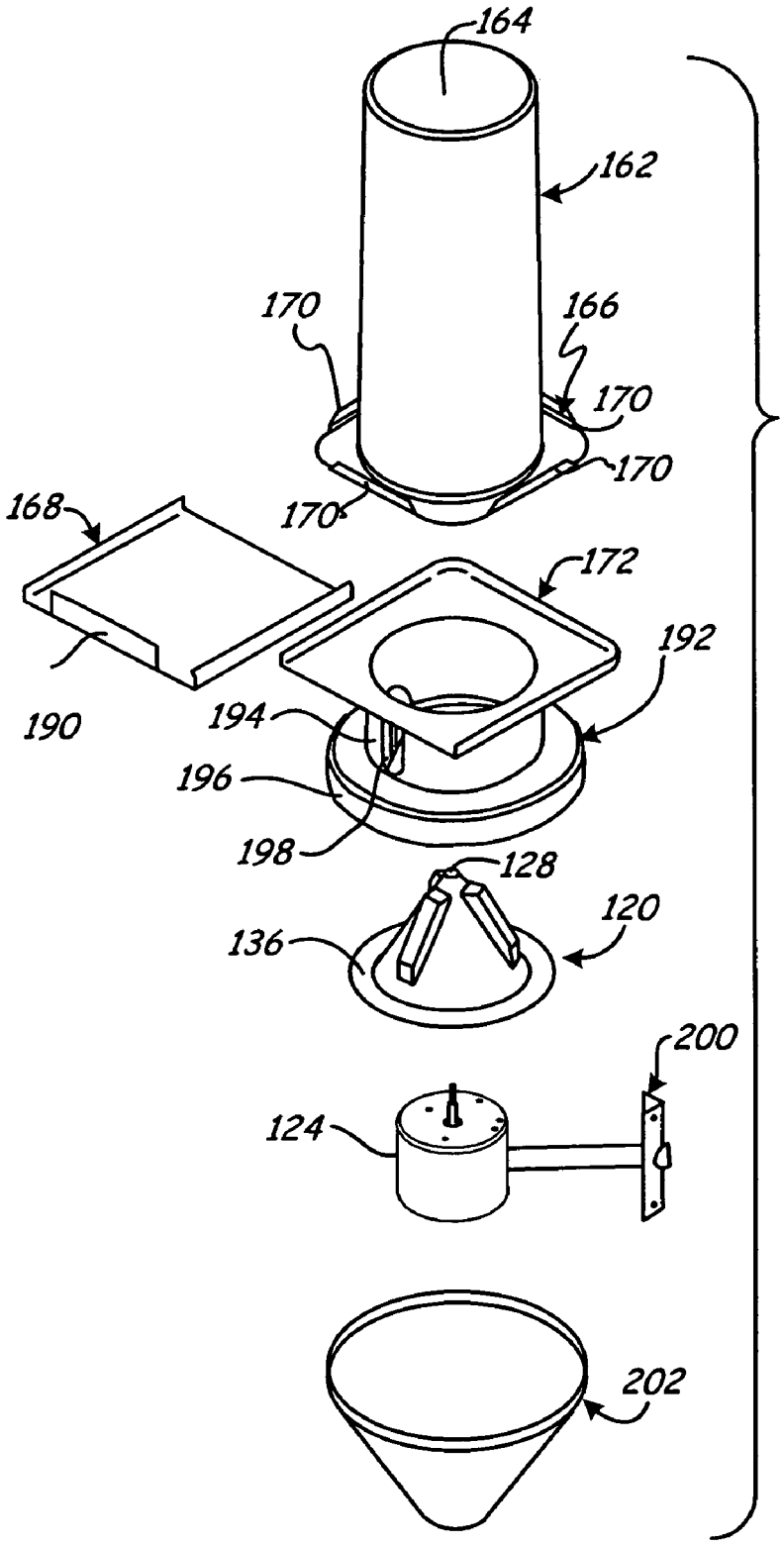
FIG. 6 is an exploded illustration of an embodiment of a dispenser assembly.
Figure 7:
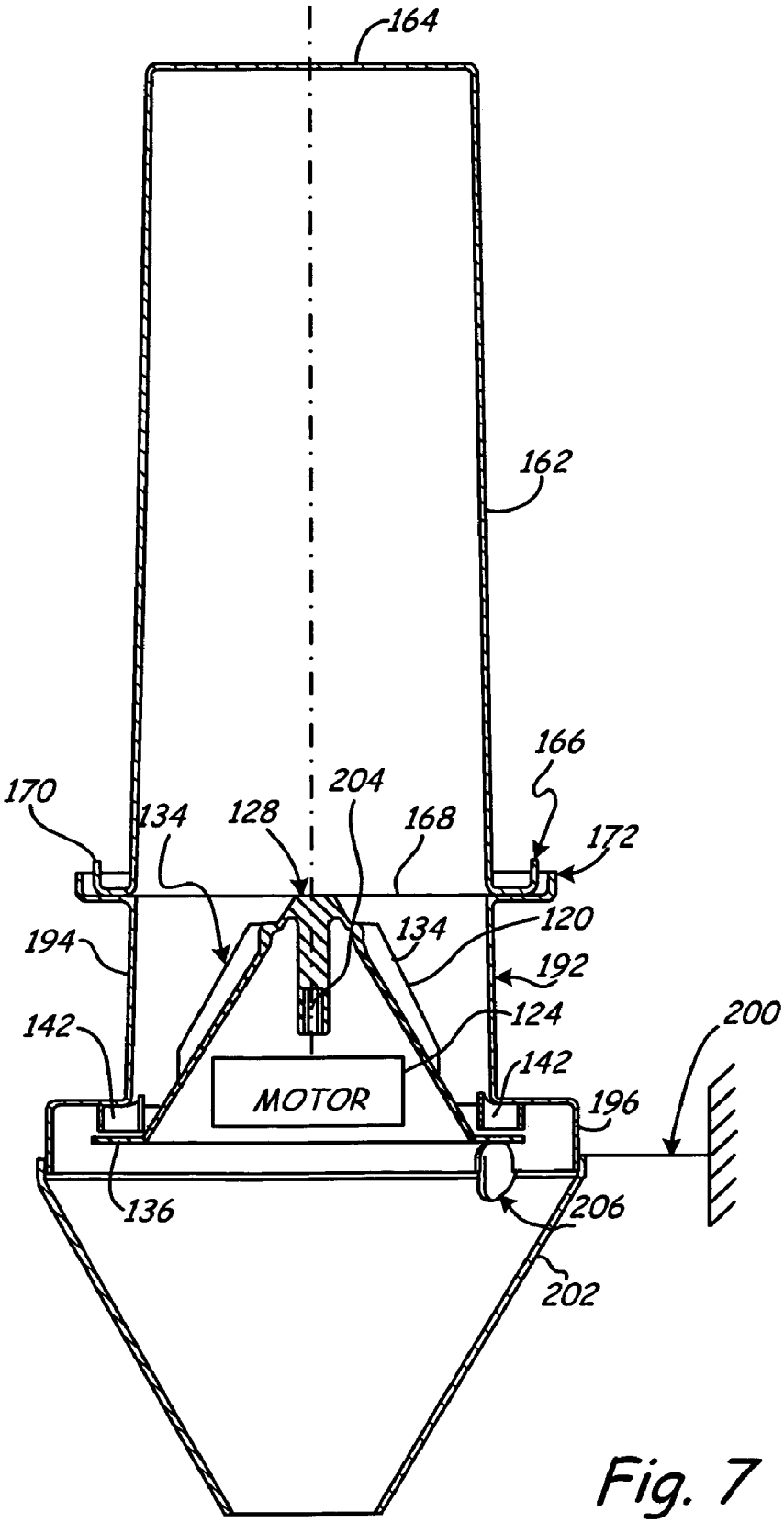
FIG. 7 is a cross-sectional view of the embodiment of the dispenser assembly illustrated in FIG. 6.

FIGS. 6–7 illustrate an embodiment of a dispensing assembly or apparatus having a rotating feed carousel where like numbers are used to refer to like parts in the previous FIGS. As shown, the dispensing assembly includes a casing 192 in which the dispenser carousel 120 is disposed for operation. In the illustrated embodiment, casing 192 includes a main body portion 194, an enlarged collar portion 196, and a flanged end forming the platform 172. In the illustrated embodiment, casing 192 is cylindrical shaped and includes an interior portion formed by a circular casing wall. The main body portion 194 of the casing 192 has a first diameter and the collar portion 196 has a second diameter larger than the diameter of the main body portion 194.

Carousel 120 is disposed in the interior portion of the casing 192 so that the tip 128 is positioned proximate or adjacent to the platform 172 and the base flange 136 of the carousel 120 is proximate to the collar portion 196 to form a dispensing opening. In the illustrate embodiment casing 192 includes a rib 198 which interfaces with product or material along the carousel 120 to disperse or "break-up" material so that it does not form a big blob or mass during the dispensing operation. Motor 124 rotates carousel 120 and is fixedly supported via bracket assembly 200. In the illustrated embodiment, a discharge cone or funnel 202 is coupled to and extends from collar 196 to form the dispensing outlet 106. The shape of the cone 202 depends upon the particular dispensing application or material.

As shown in FIG. 7, blades 142 are formed on casing 192 proximate to the collar portion 196 to interface with base flange 136 to dispense material as previously described. In the illustrated embodiment, the carousel 120 has a hollow interior portion including a motor socket 204 which, in one embodiment, is formed of a stainless steel material. A shaft of the supported motor 124 is secured therein to rotationally support the motor. Thus, the carousel 120 can be disassembled from the motor for cleaning or exchange. Components of the motor are contained in a sealed housing and the motor is secured by the bracket assembly 200 which extends through opening 206 formed through the casing and discharge cone of the illustrated embodiment or assembly.

Figure 8:
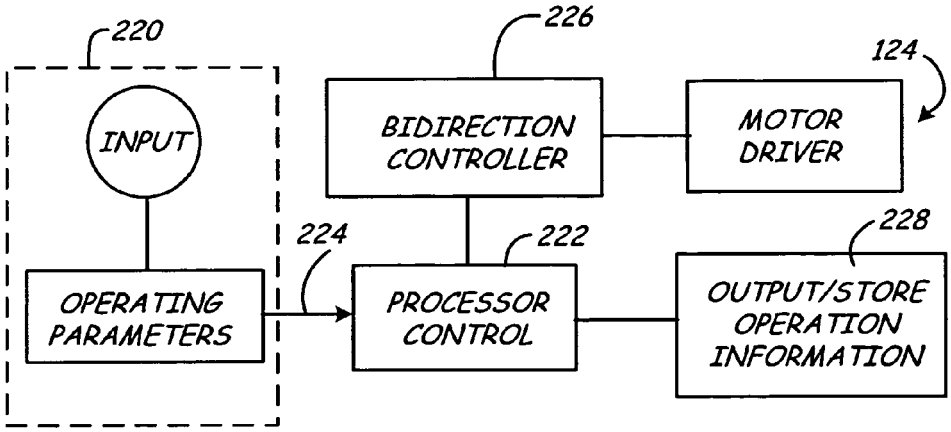
FIG. 8 is a schematic illustration of a control embodiment for a dispenser apparatus or assembly.

In the embodiment illustrated in FIG. 8, the dispenser assembly is operable to dispense a metered product amount or quantity based upon user inputted operating parameters as illustrated by block 220. In particular, the dispenser assembly can be operated based upon user defined operating parameters to dispense a desired metered quantity. A processor or controller 222 is programmed or configured to operate the motor 124 (at a calculated or set speed and duration) in response to a dispense command as illustrated by line 224 to dispense a programmed or selected quantity based upon the inputted operating parameters.

In the embodiment illustrated in FIG. 8, the motor 124 is bidirectionally controlled as illustrated by block 226 to alternate rotation directions for each dispensing cycle. As illustrated by block 228 operating information such as quantity dispensed for each dispensing cycle or predefined period is calculated and can be displayed and stored for analysis or for record keeping.

Figure 9:
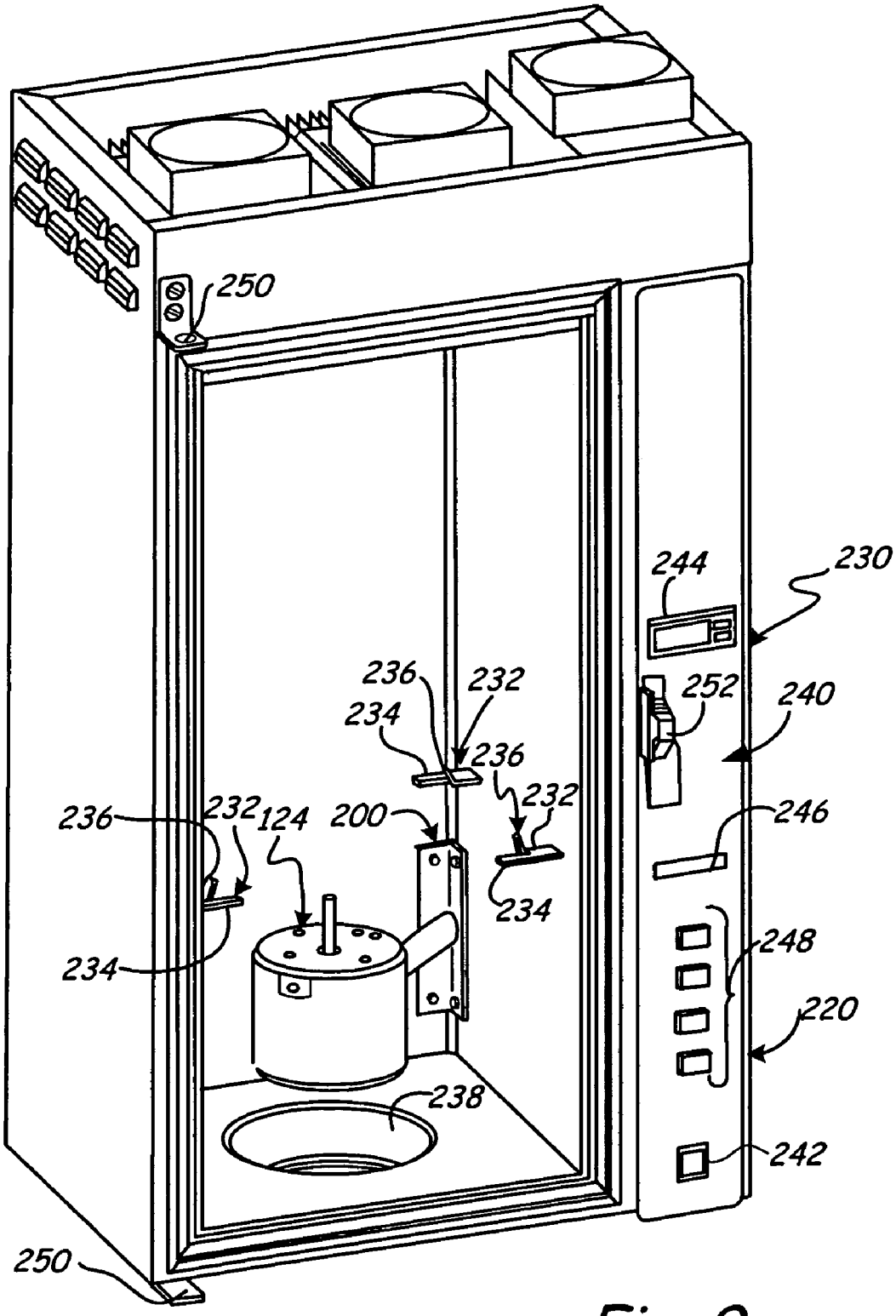
FIGS. 9–10 illustrate an embodiment of a dispenser assembly disposed in a cabinet.
Figure 10:
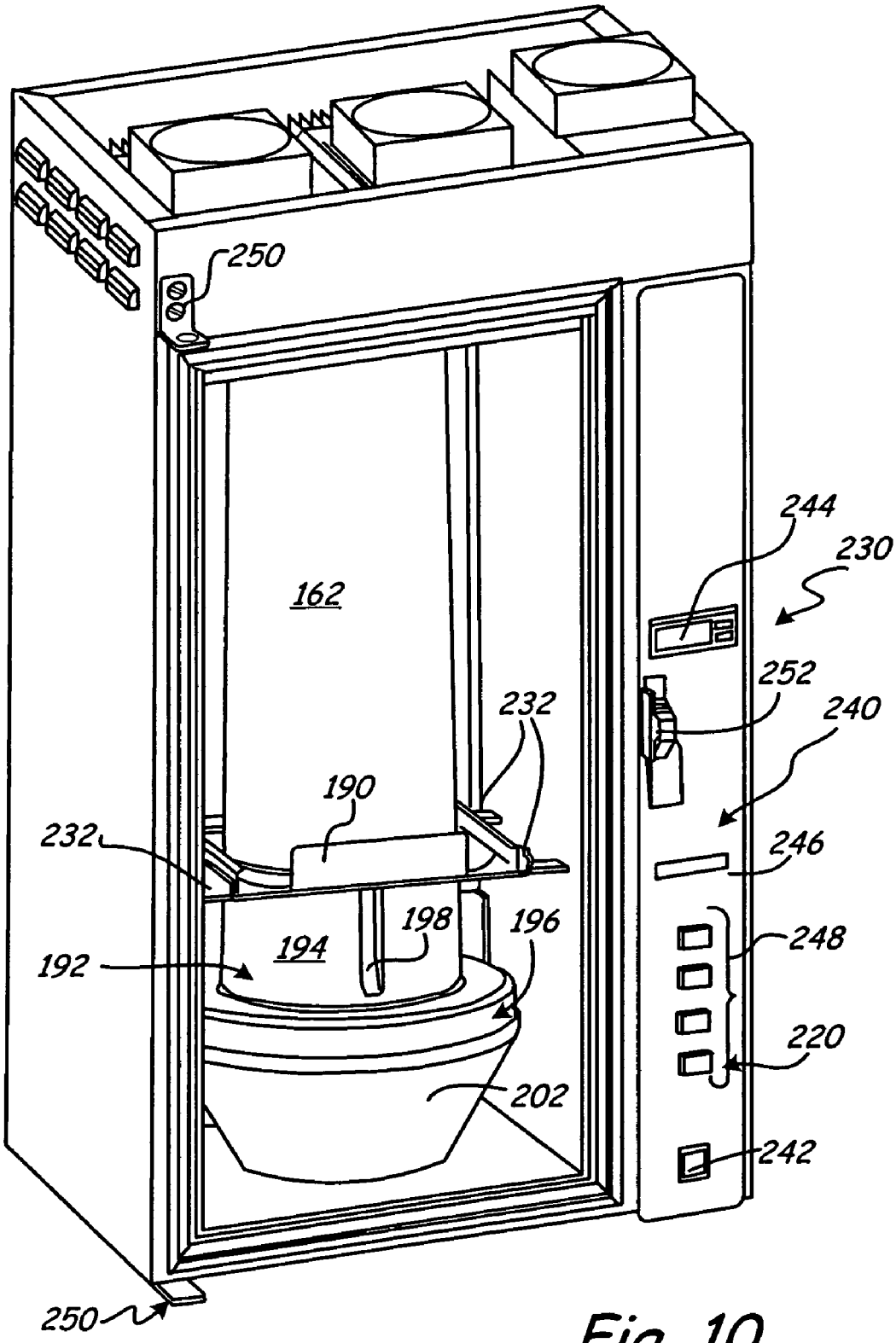

FIGS. 9–10 illustrate a dispenser embodiment housed in a cabinet 230 where like numbers are used to refer to like parts in the previous FIGS. As shown, the dispensing assembly is housed in a refrigerated cabinet 230 which is illustrated with the door removed. As illustrated in FIG. 9, motor 124 is mounted via bracket assembly 200 to the cabinet 230 and supported thereby to support the carousel 120, as previously described. Casing fixtures 232 are secured to the walls of the cabinet 230 and include a shelf portion 234 and a lip portion 236. Flanged platform 172 of casing is supported on the shelf portions 234 as illustrated in FIG. 10 and the container is assembled thereon as previously described.

Lip portions 236 interface with the raised edges 176 of the platform 172 to limit movement or rotation of the platform 172 and/or casing 192. As shown, casing 192 can be removed from fixtures 232 to disassemble the components of the apparatus. Product is dispensed through opening 238 (shown in FIG. 9) in the cabinet 230 through a discharge cone 202 assembled to the collar portion 196 of casing 192 in the embodiment illustrated in FIG. 10.

Cabinet 230 includes an operating panel 240 having an on/off button 242, a temperature control portion 244, an operating display 246 and operating control portion 248. In one embodiment, the operating control portion 248 includes preset quantity keys for dispensing preset small, medium, large and extra-large quantities. In one particular application, the small, medium, large and extra-large keys correspond to cheese quantities for small, medium, large or extra-large pizzas, although application is not limited to the particular metered quantity control shown.

The operating control keys can be predefined or can be programmed in a programming mode for customized dispensing amounts. The operating display 246 can display dispensing or operating information recorded by the apparatus, such as quantity of cheese dispensed during a shift or specified time period. Cabinet door (not shown) is pivotally secured via hinge 250 and is closed via door lock 252.

Figure 11:
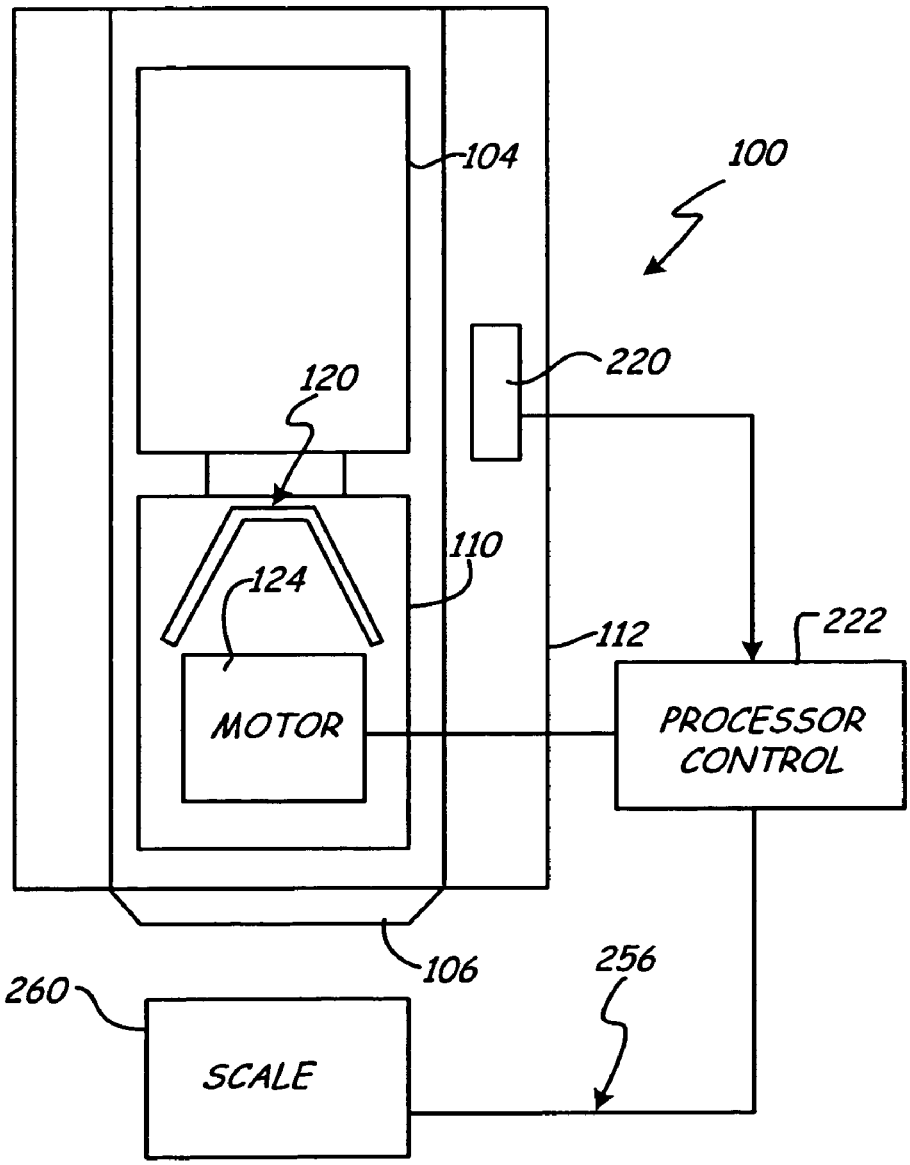
FIG. 11 is a schematic illustration of a control embodiment for metered dispensing control.

As illustrated in FIG. 11 where like numbers are used to refer to like parts in the previous FIGS., processor control 222 controls operation of motor 124 to dispense defined or selected metered quantities. In the embodiment illustrated in FIG. 11, the controller 222 operates the motor 124 based upon feedback 256 from a scale 260. Feedback 256 is used to control or turn on/off the motor when the measured quantity reaches a programmed amount to provide metered dispensing control. In particular, the controller 222 can be programmed to shut off the motor prior to a target weight or measurement to compensate for an amount that will be dispensed in an elapsed time required to execute the desired control.

Figure 12:
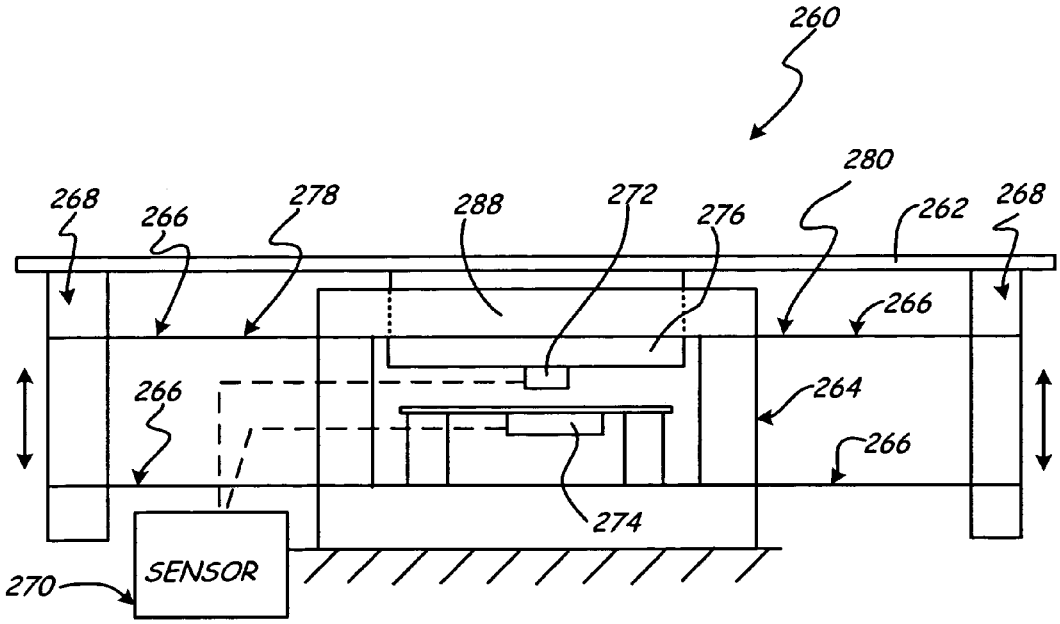
FIGS. 12–13 cooperatively illustrate an embodiment of a scale for metered dispensing control.
Figure 13:
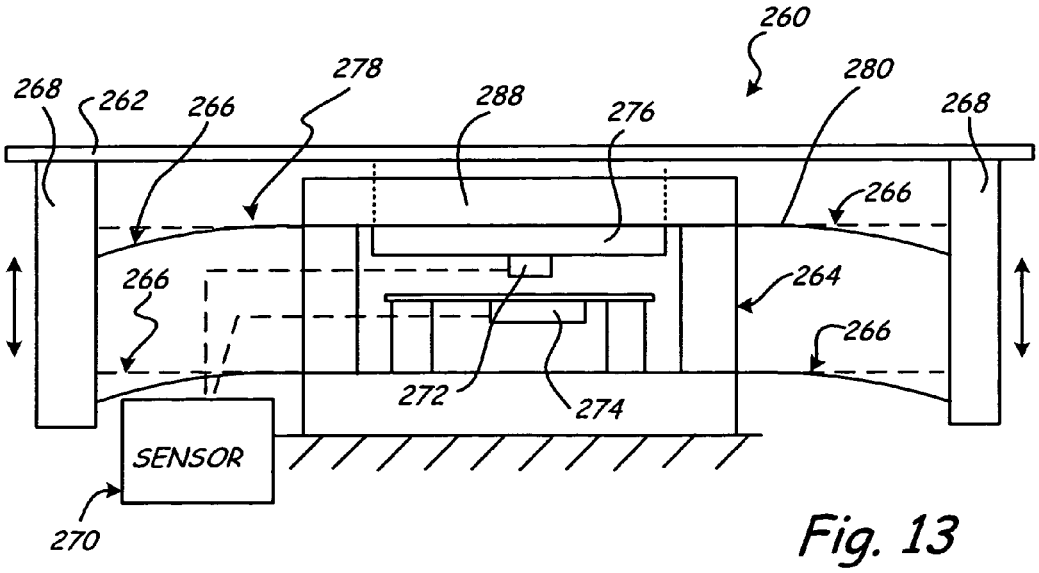

FIGS. 12–13 cooperatively illustrate an embodiment of a scale 260 to measure a dispensed quantity. As shown, scale 260 includes a floating tray 262 floatably coupled to a fixed base 264 via cantilevered beams or supports 266. Cantilevered beams or supports 266 are formed of plate-like bodies having a first end connected to the fixed base 264, a cantilevered end connected to legs 268 extending from the floating tray 262 and a cantilevered extent extending therebetween. For use, a force F or weight is supported on the tray 262 for measurement.

Beams 266 support the tray 262 such that weight on the tray 262 supplies a force to the cantilevered ends of the beams 266 which generally deflects the beams as a function of the force or weight and flexure of the beams. Tray 262 is lowered or displaced towards the fixed base 264 via the supplied weight and the flexure of beams 266 thereby as illustrated in FIG. 13. The displacement of the tray 262 is proportional to the displacement or flexure of beams 266 and is measured by sensor 270 across a floating terminal 272 coupled to tray and movable therewith and a fixed terminal 274 on the fixed base. The displacement of the tray 262 is used to calculate the weight on the tray based upon:

$$F \approx kx$$

where

F is the applied force or weight;

x is the measured displacement; and k is a spring constant of the system based upon the flexure of the beams.

In one embodiment, sensor 270 is a magnetic distance sensor including and a floating magnet supported on block 276. Movement of the magnet creates an electrical potential based upon changes in the magnetic field produced by the magnet which is measured by transducer circuitry. In the illustrated embodiment, fixed base 264 is centered and the scale includes multiple pairs of stacked beams 278, 280 on opposed sides of the fixed base 264 to reduce sensitivity to off-centered loads by keeping the motion in a linear direction or path. The first pair of stacked beams 278 extend in a first direction and the second pair of stacked beams 280 extend in a second direction. As shown, the stacked beams are parallel to provide a parallel motion under load. Although a particular embodiment is shown, application of the present invention is not limited to the multiple stacked beam pairs 278, 280 shown, for example a single pair of stacked beams could be used. Alternatively application is not limited to two stacked beams and multiple stacked beams can be used including multiple parallel stacked beams.

Figure 14:
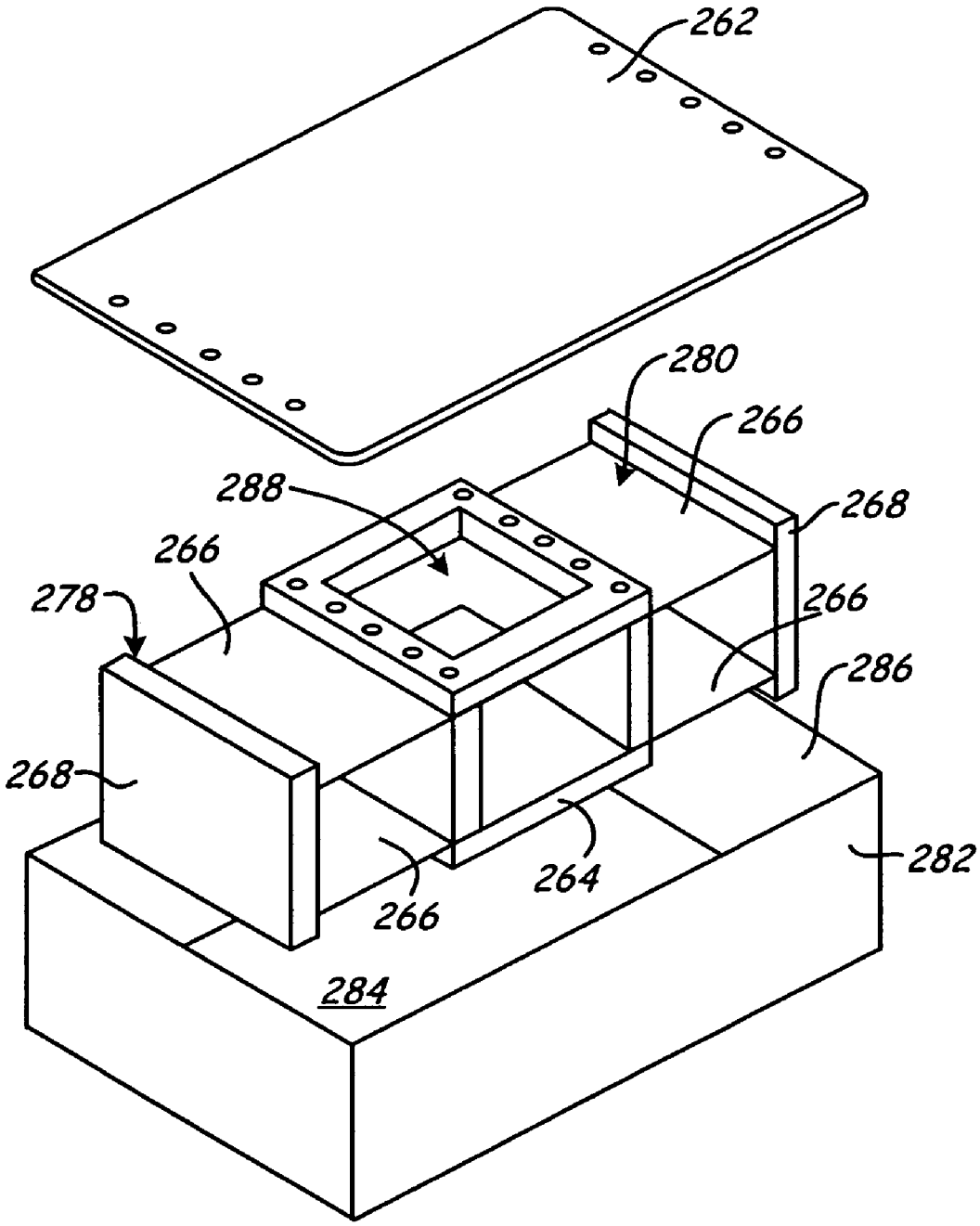
FIG. 14 illustrates an embodiment of a scale having a cantilevered interface.

As illustrated by the exploded view of FIG. 14, the fixed base 264 of the scale is secured in a housing 282 as shown having housing base 284 and cavity 286. Fixed base 264 includes opening 288 for floating terminal block 276 secured to the tray 262 and having terminal 272 supported thereby to interface with the terminal on the fixed base 264. Legs 268 extending from tray 262 contact or abut the housing base 284 to define a stop limit or overload stop for deflection of the device.

Figure 15:
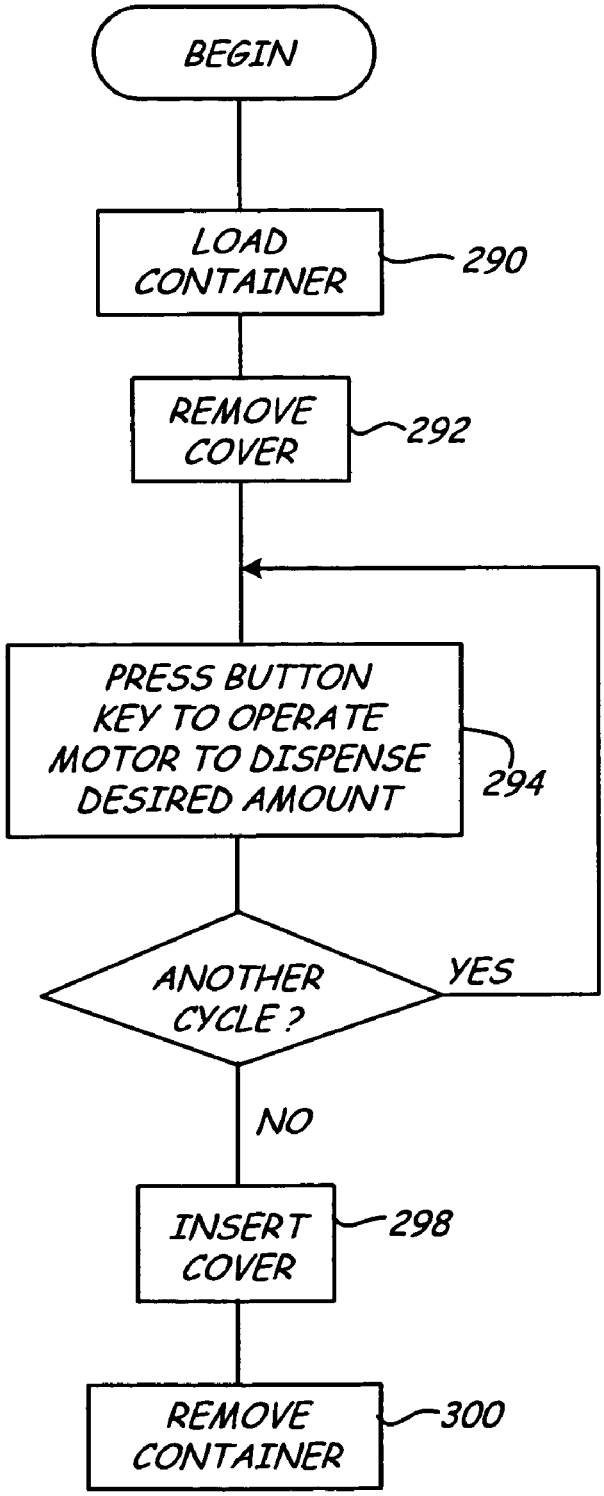
FIG. 15 is a flow chart illustrating a dispensing embodiment.

FIG. 15 illustrates a flow chart of an operation embodiment where as illustrated by blocks 290 and 292, a container is loaded and the cover is removed to dispense material. For a dispensing cycle, an operator activates a button or control to dispense a metered amount as illustrated by block 290. In the particular embodiment illustrated in FIGS. 9–10, the operator activates control keys 248 to dispense a selected small, medium, large or extra-large dispensing quantity. Following use, the container is covered as illustrated by block 298 and can be removed to clean the dispenser or to store the container as illustrated by block 300.

Although the present invention has been described with reference to preferred embodiments, workers skilled in the art will recognize that changes may be made in form and detail without departing from the spirit and scope of the invention.

What is claimed is:

1. A dispenser comprising:

a casing having an interior portion formed by a casing wall;

a rotatable dispenser carousel disposed in the interior portion of the casing along a flow path between an inlet and an outlet of the dispenser and the dispenser carousel having a cone shaped portion and a flange extending about the cone shaped portion and the flange having an inlet side and an outlet side separating an inlet side and an outlet side of the dispenser carousel; and a blade on the inlet side of the dispenser carousel proximate to the inlet side of the flange to dispense material.

2. The dispenser of claim 1 wherein the casing is cylindrically shaped.

3. The dispenser of claim 1 wherein the cone shaped portion of the dispenser carousel includes a plurality of longitudinally extending ribs to promote material flow.

4. The dispenser of claim 1 wherein the dispenser includes a plurality of blades on the inlet side of the dispenser carousel to discharge material.

5. The dispenser of claim 4 wherein the plurality of blades includes a first blade and a second blade spaced 180° degrees from the first blade.

6. The dispenser of claim 4 wherein the plurality of blades are integrally formed on an inner surface of the casing.

7. The dispenser of claim 1 wherein the blade includes an angled surface relative, to a rotation direction of the dispenser carousel.

8. The dispenser of claim 1 wherein the casing includes a flanged platform and the dispenser includes a cabinet and the flanged platform of the casing is slidably mounted on brackets in the cabinet.

9. The dispenser of claim 1 wherein the dispenser includes a tapered discharge cone.

10. The dispenser of claim 1 wherein the casing includes a body portion and an enlarged collar portion having a transversely extending portion and the dispenser carousel is disposed in the body portion of the casing and the flange is positioned proximate to the enlarged collar portion to form a passage between a transversely extending flange surface and the enlarged collar portion of the casing to dispense material.

11. The dispenser of claim 1 wherein the flange and the blade form abutting surfaces for dispensing material.

12. The dispenser of claim 1 wherein the dispenser carousel includes multiple rotation directions and the blade includes opposed angled surfaces relative to the multiple rotation directions.

13. The dispenser of claim 1 and further comprising a motor assembly coupled to the dispenser carousel and operable to rotate the dispenser carousel.

14. The dispenser of claim 13 wherein the dispenser carousel includes a hollow interior portion including a motor socket and a shaft of the motor assembly is insertable in the motor socket to rotate the dispenser carousel.

15. The dispenser of claim 13 wherein the casing is supported in a refrigerated cabinet and the dispenser carousel and the motor assembly are disposed in the refrigerated cabinet.

16. A dispenser comprising:

a casing having an interior portion formed by a casing wall;

an inlet and an outlet;

a dispenser carousel disposed in the interior portion of the casing and interposed in a flow path between the inlet and the outlet;

a motor assembly operable to rotate the dispenser carousel in a clockwise and a counterclockwise direction; and a dispense controller programmed to operate the motor assembly in response to a dispense command and the controller is programmed to intermittently operate the motor assembly in the clockwise direction and the counterclockwise direction in response to sequential dispense commands.

17. The dispenser of claim 16 wherein the dispense controller operates the motor assembly to dispense a metered quantity of material.

18. The dispenser of claim 17 and further comprising a user interface having a plurality of control inputs corresponding to a plurality of metered dispense quantities.

19. The dispenser of claim 17 including user programmable dispense parameters.

20. The dispenser of claim 16 wherein the dispenser carousel includes a plurality of spaced ribs to promote material flow.

21. A method for dispensing material comprising steps of:

loading a material container on a platform having a cover separating a content of the container from an inlet to a dispenser carousel;

removing the cover of the container so that the content of the container is opened to the inlet to the dispenser carousel;

rotating the dispenser carousel to dispense material from the container;

replacing the cover of the container so that the content of the container is closed to the inlet to the dispenser carousel; and wherein the step of loading the container comprises sliding a flanged end of the container through a slot on the platform of a casing of a dispenser having the dispensing carousel rotatable in the casing and aligning the flanged end of the container to abut raised edge portions of the platform of the dispenser.

22. The method of claim 21 comprising the steps of:

rotating the dispenser carousel in a first direction for a first period in response to a first dispensing command to dispense the material during a first dispense cycle; and rotating the dispenser carousel in a second direction for a second period in response to a second dispensing command to dispense the material during a second dispense cycle.

* * * * *